US010079430B2

(12) United States Patent
Govoni

(10) Patent No.: US 10,079,430 B2
(45) Date of Patent: Sep. 18, 2018

(54) ANTENNA MOUNT

(71) Applicant: The United States of America, as represented by the Secretary of the Army, Washington, DC (US)

(72) Inventor: Mark Govoni, Abingdon, MD (US)

(73) Assignee: The United States of America, as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/996,251

(22) Filed: Jan. 15, 2016

(65) Prior Publication Data

US 2017/0207526 A1 Jul. 20, 2017

(51) Int. Cl.

| | |
|---|---|
| ***H01Q 13/00*** | (2006.01) |
| ***H01Q 1/52*** | (2006.01) |
| ***H01Q 1/24*** | (2006.01) |
| ***H01Q 5/307*** | (2015.01) |

(52) U.S. Cl.
CPC ..... *H01Q 1/525* (2013.01); *H01Q 1/24* (2013.01); *H01Q 5/307* (2015.01)

(58) Field of Classification Search
CPC ..... H01Q 1/525; H01Q 1/24; H01Q 5/307; H01Q 13/00; H01Q 13/04
See application file for complete search history.

(56) References Cited

U.S. PATENT DOCUMENTS

| | | | | |
|---|---|---|---|---|
| 4,037,229 | A | 7/1977 | Dunk | |
| 4,151,533 | A | 4/1979 | Vogt | |
| 4,454,515 | A | 6/1984 | Major et al. | |
| 4,625,213 | A | 11/1986 | Horn | |
| 5,049,896 | A | 9/1991 | Conley | |
| 5,103,236 | A | 4/1992 | DuShane | |
| 5,229,784 | A | 7/1993 | Jones | |
| 5,473,335 | A * | 12/1995 | Tines | H01Q 3/04 248/652 |
| 5,546,094 | A | 8/1996 | Egashira | |
| 5,886,674 | A | 3/1999 | Yoshimi | |
| 5,918,183 | A | 6/1999 | Janky et al. | |
| 5,929,816 | A | 7/1999 | Gross et al. | |
| 6,271,797 | B2 | 8/2001 | Miller | |
| 6,563,475 | B2 | 5/2003 | Ianello et al. | |
| 7,038,628 | B1 | 5/2006 | Rausch | |
| 7,089,018 | B2 | 8/2006 | Galetti | |
| 7,675,475 | B2 | 3/2010 | Brandstetter | |
| 8,339,329 | B2 | 12/2012 | Shen | |
| 8,810,463 | B2 | 8/2014 | Kirkham | |
| 8,896,497 | B1 | 11/2014 | Kullman et al. | |
| 9,136,582 | B2 | 9/2015 | Lewry et al. | |
| 2001/0015707 | A1 | 8/2001 | Oby | |
| 2002/0097187 | A1 * | 7/2002 | Imaizumi | H01Q 1/247 343/757 |

(Continued)

*Primary Examiner* — Dieu H Duong
*Assistant Examiner* — Bamidele A Jegede
(74) *Attorney, Agent, or Firm* — Ronald Krosky; Azza Jayaprakash

(57) ABSTRACT

Various embodiments are described that relate to an antenna mount. Multiple antennas can be mounted on the antenna mount. These antennas can work together or be independent of one another. In an example of working together, one antenna can be a transmission antenna while the second antenna can be a reception antenna. The transmission antenna and reception antenna can function with regard to the same communication signal.

20 Claims, 9 Drawing Sheets

(56) References Cited

U.S. PATENT DOCUMENTS

| | | | | |
|---|---|---|---|---|
| 2003/0071762 | A1 | 4/2003 | Tulloch | |
| 2006/0038736 | A1* | 2/2006 | Hui | H01Q 1/521 343/835 |
| 2006/0287759 | A1 | 12/2006 | Charych | |
| 2009/0128396 | A1* | 5/2009 | Fehrenbach | G01F 23/284 342/124 |
| 2009/0156118 | A1 | 6/2009 | Schadler | |
| 2009/0267852 | A1* | 10/2009 | Tahmisian, Jr. | G01S 13/762 343/776 |
| 2010/0295703 | A1 | 11/2010 | Weston et al. | |
| 2011/0279337 | A1 | 11/2011 | Corwin et al. | |
| 2012/0199720 | A1 | 8/2012 | Miller | |
| 2013/0271334 | A1* | 10/2013 | Tahmisian, Jr. | H01Q 25/02 343/776 |
| 2014/0085129 | A1* | 3/2014 | Westerling | H01Q 9/28 342/124 |
| 2015/0301275 | A1* | 10/2015 | Andle | G02B 6/4215 385/43 |

* cited by examiner

ANTENNA MOUNT

GOVERNMENT INTEREST

The innovation described herein may be manufactured, used, imported, sold, and licensed by or for the Government of the United States of America without the payment of any royalty thereon or therefor.

BACKGROUND

A plurality of users can employ communication devices in order to communicate with one another. Individual communication devices can employ at least one antenna in order to achieve desired communication results. It is possible that communications from multiple antennas can cause interference with one another. This interference can be undesirable.

SUMMARY

In one embodiment, a housing comprises a first antenna retention portion and a second antenna retention portion. The first antenna retention portion can be configured to retain a first antenna at a first position and the second antenna retention portion can be configured to retain a second antenna at a second position. The first position and the second position can cause the first antenna and the second antenna to function without interfering with one another. Additionally, the first position can cause communication of the first antenna to be non-physically influenced by the housing.

In another embodiment, a system comprises a first antenna mount configured to support a first antenna and a second antenna mount configured to support a second antenna. The first antenna mount and the second antenna mount are physically connected to one another. The system also comprises a separator configured to separate the first antenna when mounted from the second antenna when mounted, configured to cause the first antenna to not interfere with itself, and configured to cause the second antenna to not interfere with itself.

In yet another embodiment, a system comprises a first antenna base configured to support a first antenna, a second antenna base configured to support a second antenna, and a divider configured to prevent coupling between the first antenna and the second antenna. The first antenna base, the second antenna base, and the divider can be part of the housing. The first antenna base and the second antenna base can be configured to have the first antenna and the second antenna physically align about flush with one another along a plane of their main transmission side.

BRIEF DESCRIPTION OF THE DRAWINGS

Incorporated herein are drawings that constitute a part of the specification and illustrate embodiments of the detailed description. The detailed description will now be described further with reference to the accompanying drawings as follows.

DETAILED DESCRIPTION

Figure 1A:
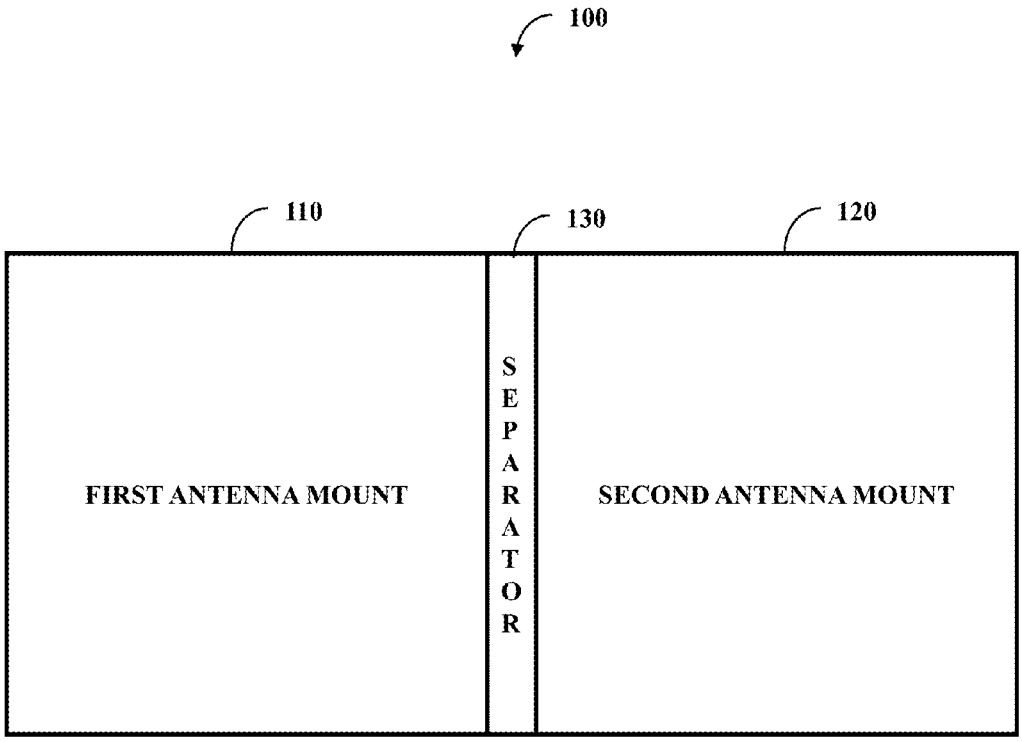
FIG. 1*a* illustrates one embodiment of a system comprising a first antenna mount, a second antenna mount, and a separator.

In one embodiment, an antenna mount (e.g., multiple antenna mounts) can be used to mount multiple antennas (or antennae). This mount can allow for both antennas to operate without interference from the other and interference from itself. With this mount, multiple antennas can function together while in close proximity to one another.

The antenna mount can be a mechanical housing to two or more commercial-off-the-shelf antennas, such as wideband horn antennas. The housing can be structured such that individual antennas can be independently changed with regard to their orientation. The housing can also cause radio frequency isolation between antennas and be mounted upon a pedestal.

The following includes definitions of selected terms employed herein. The definitions include various examples. The examples are not intended to be limiting.

"One embodiment", "an embodiment", "one example", "an example", and so on, indicate that the embodiment(s) or example(s) can include a particular feature, structure, characteristic, property, or element, but that not every embodiment or example necessarily includes that particular feature, structure, characteristic, property or element. Furthermore, repeated use of the phrase "in one embodiment" may or may not refer to the same embodiment.

"Computer-readable medium", as used herein, refers to a medium that stores signals, instructions and/or data. Examples of a computer-readable medium include, but are not limited to, non-volatile media and volatile media. Non-volatile media may include, for example, optical disks, magnetic disks, and so on. Volatile media may include, for example, semiconductor memories, dynamic memory, and so on. Common forms of a computer-readable medium may include, but are not limited to, a floppy disk, a flexible disk, a hard disk, a magnetic tape, other magnetic medium, other optical medium, a Random Access Memory (RAM), a Read-Only Memory (ROM), a memory chip or card, a memory stick, and other media from which a computer, a processor or other electronic device can read. In one embodiment, the computer-readable medium is a non-transitory computer-readable medium.

"Component", as used herein, includes but is not limited to hardware, firmware, software stored on a computer-readable medium or in execution on a machine, and/or combinations of each to perform a function(s) or an action(s), and/or to cause a function or action from another component, method, and/or system. Component may include a software controlled microprocessor, a discrete component, an analog circuit, a digital circuit, a programmed logic device, a memory device containing instructions, and so on. Where multiple components are described, it may be possible to incorporate the multiple components into one physical component or conversely, where a single component is described, it may be possible to distribute that single component between multiple components.

"Software", as used herein, includes but is not limited to, one or more executable instructions stored on a computer-readable medium that cause a computer, processor, or other electronic device to perform functions, actions and/or behave in a desired manner. The instructions may be embodied in various forms including routines, algorithms, modules, methods, threads, and/or programs including separate applications or code from dynamically linked libraries.

Figure 1B:
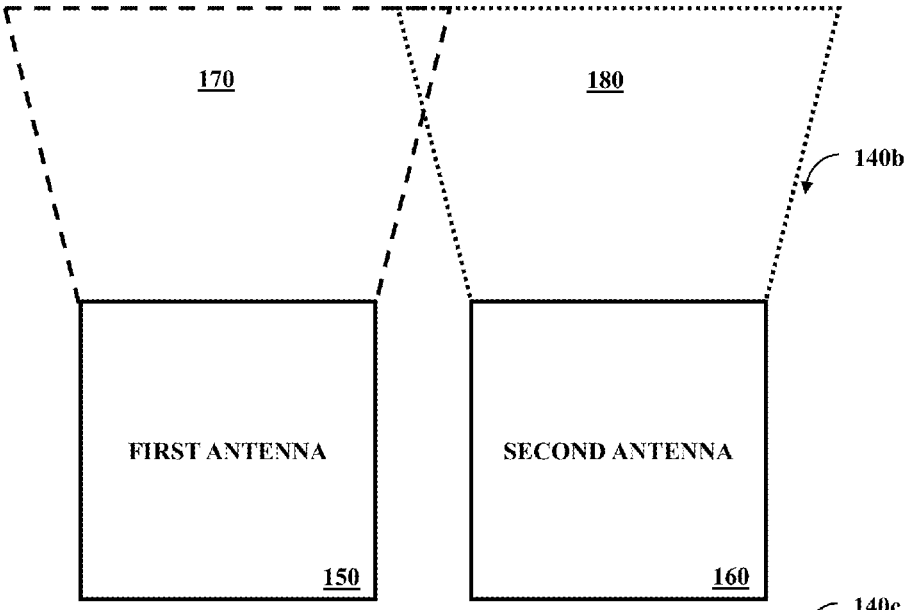
FIG. 1*b* illustrates one embodiment of an environment with a first antenna and a second antenna with their respective outputs.
Figure 1C:
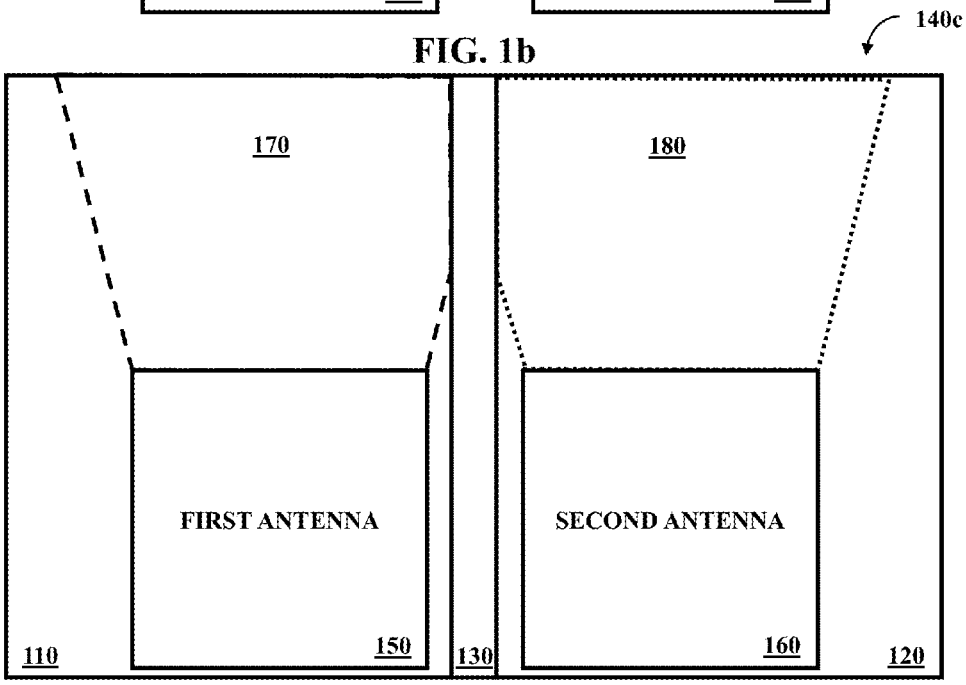
FIG. 1*c* illustrates one embodiment of an environment employing the first antenna mount, the second antenna mount, and the separator.

FIG. 1*a* illustrates one embodiment of a system comprising a first antenna mount 110, a second antenna mount 120, and a separator 130. FIG. 1*b* illustrates one embodiment of an environment 140*b* with a first antenna 150 and a second antenna 160 with their respective outputs 170 and 180. FIG. 1*c* illustrates one embodiment of an environment 140*c* employing the first antenna mount 110, the second antenna mount 120, and the separator 130. These drawings may be referred to collectively as "FIG. 1."

The first antenna mount 110 and the second antenna mount 120 can be physically connected to one another. In one example, the first antenna mount 110 and the second antenna mount 120 can share a physical base and protrude from the base. The separator 130 can also be physically connected to the antenna mounts 110 and 120, such as connecting with the physical base. The first antenna mount 110 can be configured to support the first antenna 150 and the second antenna mount 120 can be configured to support the second antenna 160.

The separator 130 can improve performance of the antennas 150 and 160. The separator 130 can be configured to separate the first antenna 150 when mounted from the second antenna 160 when mounted. The separator 130 can be configured to cause the first antenna 150 to not interfere with itself and can be configured to cause the second antenna 160 to not interfere with itself. Also, the separator 130 can be configured to separate the first antenna 150 from the second antenna 160 such that the first antenna 150 does not interfere with the second antenna 160. Similarly, this can be such that the second antenna 160 does not interfere with the first antenna 150.

With FIG. 1*b*, the antennas 150 and 160 function absent the system 100. The first antenna 150 transmits a first output 170 and the second antenna 160 transmits a second output 180. In one example, the outputs 170 and 180 are signals. As one can see, the outputs 170 and 180 partially overlap and this overlap can cause interference of both outputs 170 and 180. Oftentimes in wireless communication, interference is an undesired quality.

With FIG. 1*c*, the environment 140*c* can cause mitigation or elimination of this interference. The separator 130 can be made of an absorptive material and/or be physically shaped to be absorptive, such as by including cones. With this, the separator 130 can prevent the outputs 170 and 180 from overlapping and therefore interfering. Additionally, the separator 130 being absorptive can also cause the antennas 150 and 160, and in turn their respective outputs 170 and 180, to not interfere with themselves. In thus, there can be a lowering (e.g., elimination) of bias from one antenna to another. If the separator 130 is not absorptive, then it is possible for the separator 130 to reflect the outputs 170 and 180 back and cause interference. In one embodiment, the outputs 170 and 180 can interfere with one another and yet not interfere with themselves by way of reflection. In this example, once the outputs 170 and 180 go beyond the system 100, then they may interfere with one another. Example interference that can be eliminated with practice of innovations disclosed herein includes radio frequency (RF) coupling.

Figure 2A:
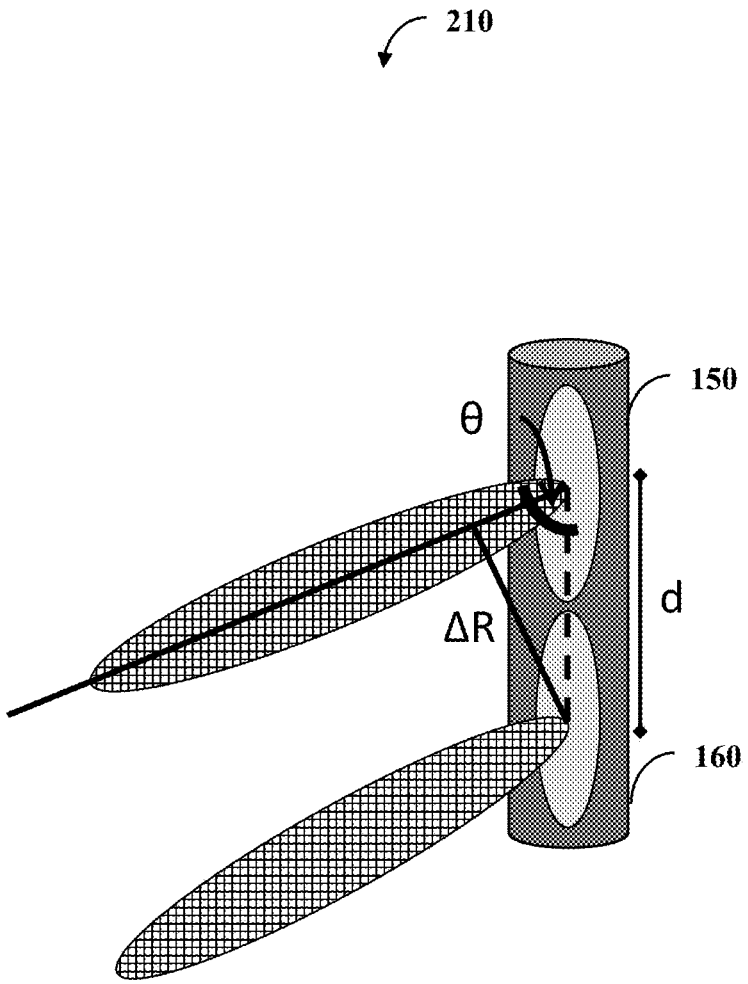
FIG. 2*a* illustrates one embodiment of a quasi-monostatic antenna configuration.
Figure 2B:
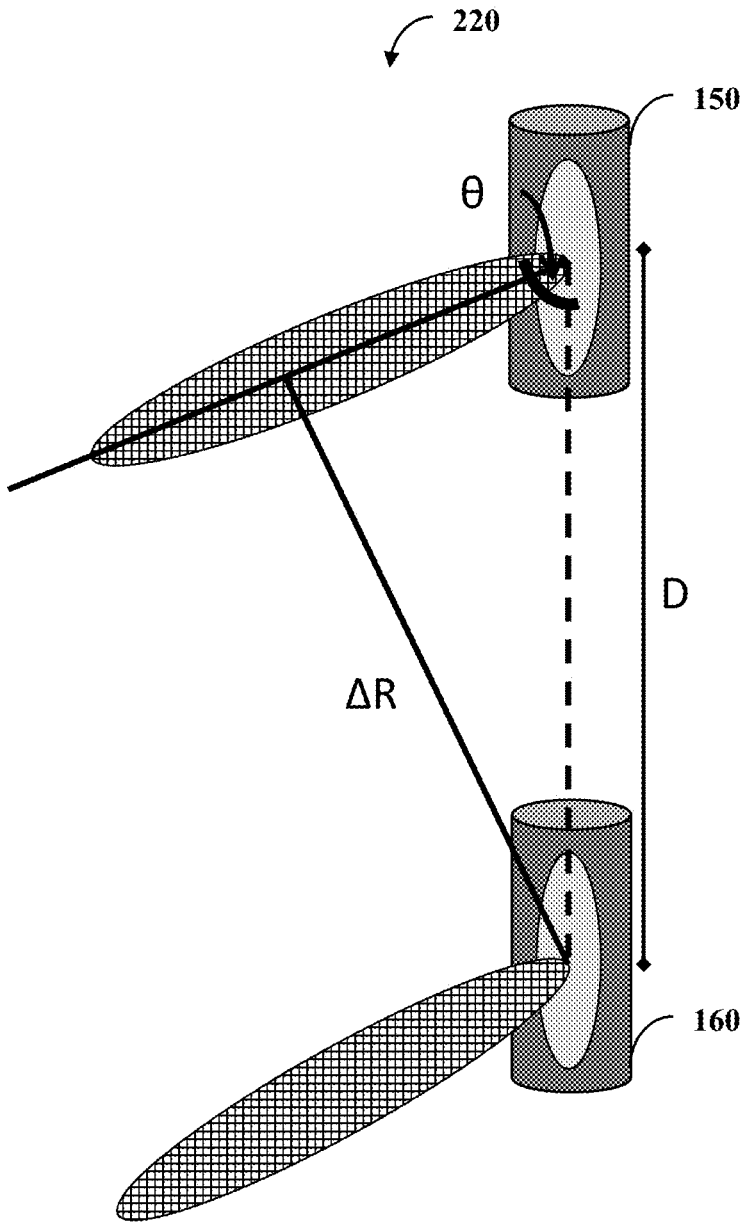
FIG. 2*b* illustrates one embodiment of a bistatic antenna configuration.

FIG. 2*a* illustrates one embodiment of a quasi-monostatic antenna configuration 210. FIG. 2*b* illustrates one embodiment of a bistatic antenna configuration 220. These drawings may be referred to collectively as "FIG. 2." Other configurations can be employed other than quasi-monostatic and bistatic, such as a multistatic configuration.

The two antennas 150 and 160 can be used in RF data collection bay way of different configurations, such as the quasi-monostatic antenna configuration 210 or the bistatic configuration 220. With the quasi-monostatic antenna configuration 210, the two antennas 150 and 160 can, in one embodiment, fuse into one physical antenna. With these configurations, having a rigid mounting structure, such as a structure built to pre-determined specifications, can cause symmetry between the two antennas 150 and 160.

In one embodiment, the antennas 150 and 160 can function independently. With this, the antennas can function at different frequencies. Therefore, the system 100 of FIG. 1*a* can conveniently function as a retainer of multiple, unrelated antennas.

In one embodiment, the antennas 150 and 160 can function in an interdependent manner. In one example, the first antenna 150 can be a transmission antenna configured to transmit a signal (e.g., output 170 of FIG. 1). The second antenna 160 can be a reception antenna configured to receive a response to the signal after transmission (e.g., output 180 of FIG. 1). Therefore, the two antennas 150 and 160 can work together while integrated upon the system 100 of FIG. 1*a*.

In FIG. 2, "d" and "D" represent physical separation between phase centers of the antennas 150 and 160. In general, a smaller separation can be used in the quasi-monostatic antenna configuration 210 since a range to target is likely to be much greater than the physical separation between the antenna phase centers. The case when the physical separation is large relative to the range to target can be used in the bistatic antenna configuration 220. "$\Delta R$" can be considered antenna path loss that can be defined as separation between antenna beams pointed in a direction "$\Theta$" relative to antenna normal (e.g., the direction can be arbitrary). These can be interrelated by $\Delta R = d \sin \Theta$ or $\Delta R = D \sin \Theta$.

Figure 3:
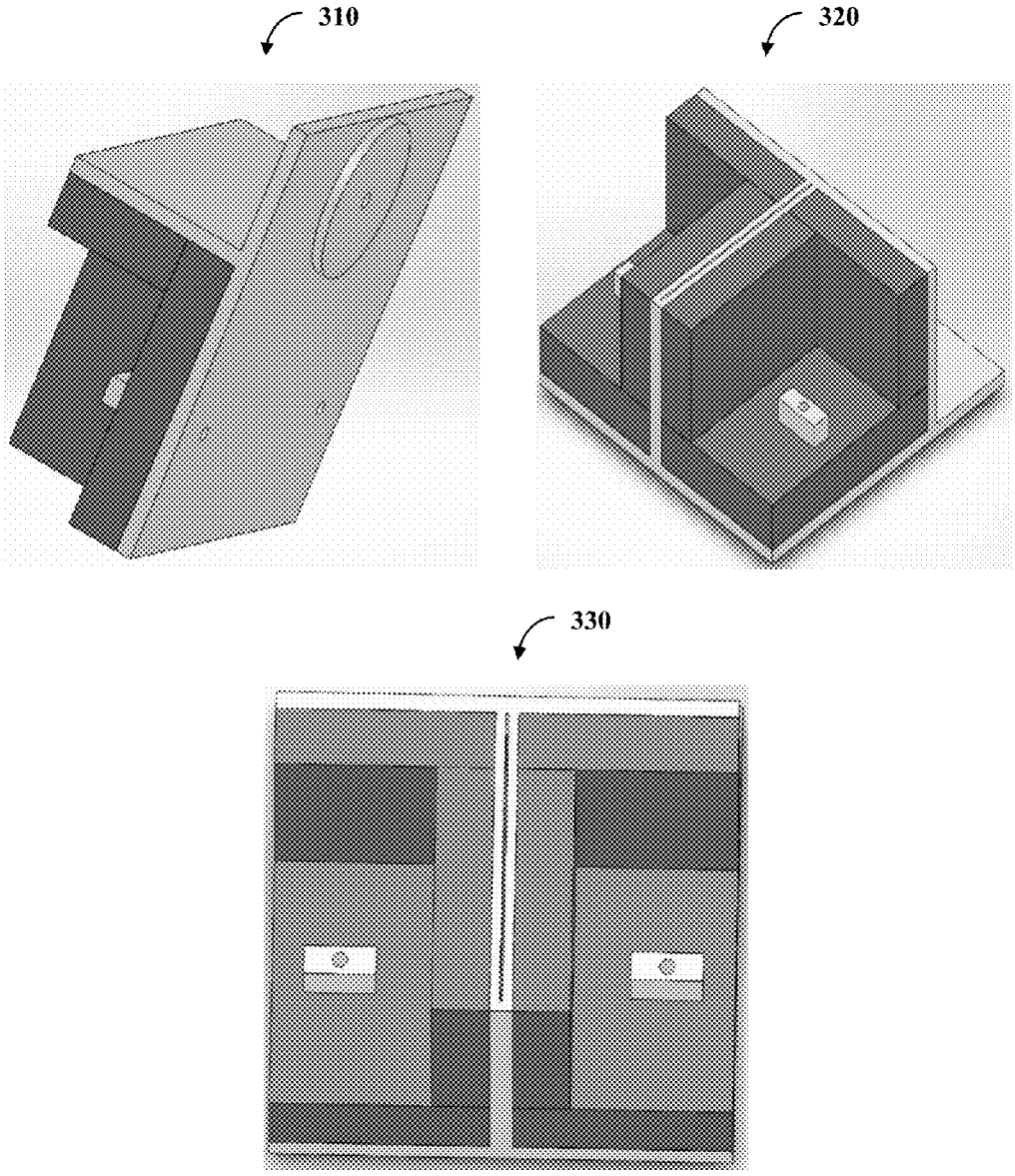
FIG. 3 illustrates one embodiment of three views of a first antenna mount.

FIG. 3 illustrates one embodiment of three views 310-330 of a first antenna mount arrangement. The view 310 illustrates a reception portion that can be used to couple the mount to a pedestal, a vehicle, or other structure. The views 320 and 330 illustrate how reception portions can be separated by a separator while still be part of one structure. In one embodiment, the first antenna mount arrangement can be constructed from a resin through employment of three-dimensional printing techniques. While not illustrated, the first antenna mount arrangement can comprise an RF-absorptive material that is placed around surface cavities.

Figure 4:
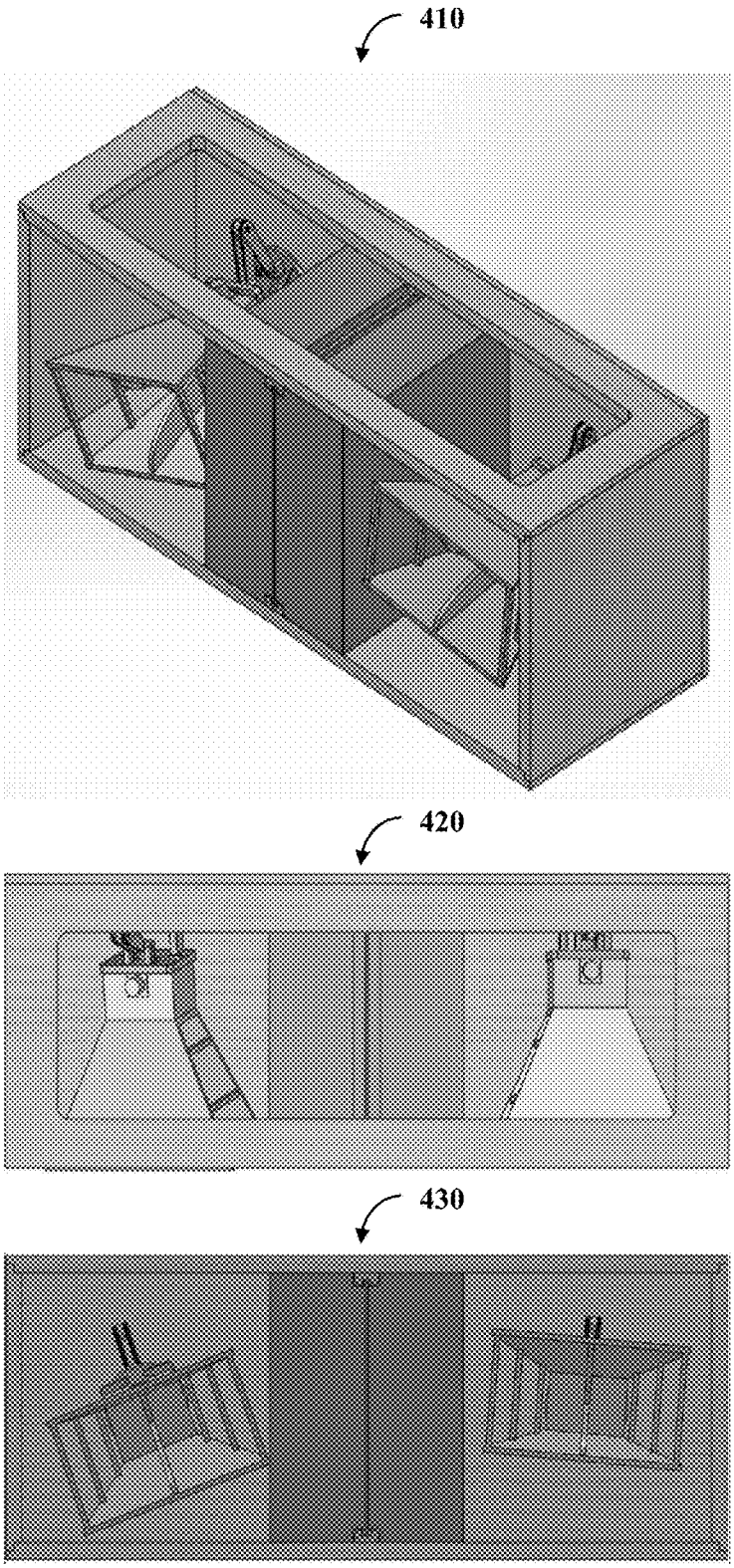
FIG. 4 illustrates one embodiment of three views of a second antenna mount.

FIG. 4 illustrates one embodiment of three views 410-430 of a second antenna mount arrangement. View 410 illustrates a perspective view, view 420 illustrates a top-down view, and view 430 illustrates a forward-facing view. In one embodiment, the second antenna mount arrangement can be constructed from wood and be built by a carpenter or machine.

The first antenna mount arrangement (discussed with FIG. 5) and the second antenna mount arrangement can be designed for a zero-transition plane for potential RF-coupling between the two antennas 150 and 160 of FIG. 1 (e.g., antenna 150 being a transmission antenna and antenna 160 being a reception antenna). The two antennas 150 and 160 can be independently or dependently moved. This movement can be vertically, horizontal, and/or rotational. Further, this movement can be done by hand or done by way of an apparatus, such as instructions sent from a control system.

Additionally, movement of mount pieces themselves can occur. In one example, the separator 130 of FIG. 1 can be moved along the x-axis, y-axis, and/or z-axis. In another example, the first antenna mount 110 and the second antenna mount 120 can individually comprise hardware for coupling the antennas 150 and 160 of FIG. 1 to their respective mount. This hardware can be moved, such as to define polarization of emitted transverse electromagnetic waves. In this example, moving the mounting hardware can also move the antennas themselves. However, the mounting hardware can be configured to be moved without antennas coupled.

Figure 5:
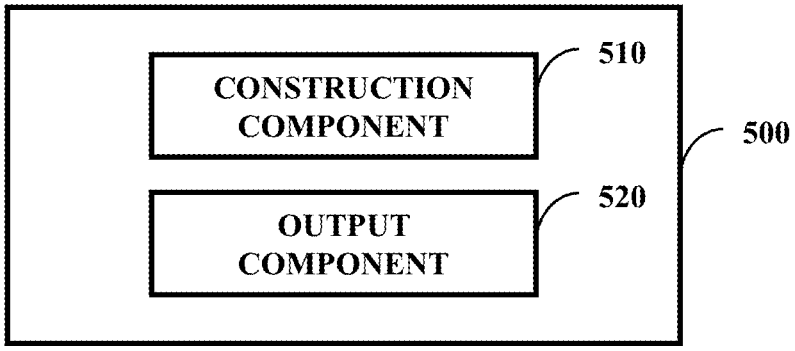
FIG. 5 illustrates one embodiment of a system comprising a construction component and an output component.

FIG. 5 illustrates one embodiment of a system 500 comprising a construction component 510 and an output component 520. The construction component 510 can build the system 100 of FIG. 1 or another physical object (e.g., the arrangements discussed in FIGS. 3 and 4). In one example, the construction component 510 can receive input parameters and use these parameters to build the system 100 of FIG. 1. The construction component 510 can comprise manufacturing machinery employed for such a build. Once constructed, the output component 520 can cause an output of a finished product—such as the system 100 of FIG. 1 or a system described in the method 700 discussed below with regard to FIG. 7.

Figure 6:
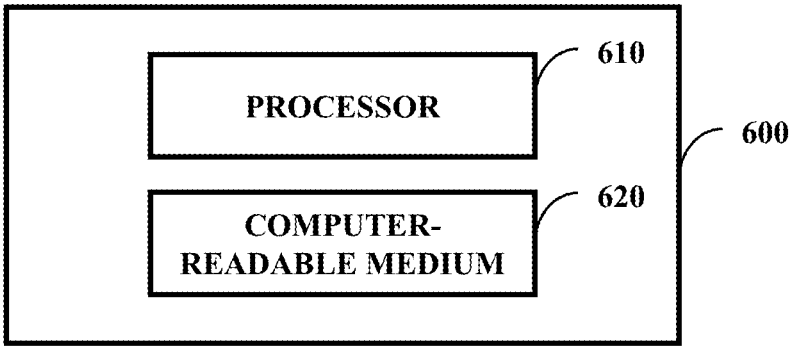
FIG. 6 illustrates one embodiment of a system comprising a processor and a computer-readable medium.

FIG. 6 illustrates one embodiment of a system 600 comprising a processor 610 (e.g., a general purpose processor or a processor specifically designed for performing functionality disclosed herein) and a computer-readable medium 620 (e.g., non-transitory computer-readable medium). In one embodiment, the computer-readable medium 620 is communicatively coupled to the processor 610 and stores a command set executable by the processor 610 to facilitate operation of at least one component disclosed herein (e.g., the construction component 510 of FIG. 5). In one embodiment, at least one component disclosed herein (e.g., the output component 520 of FIG. 5) can be implemented, at least in part, by way of non-software, such as implemented as hardware by way of the system 600. In one embodiment, the computer-readable medium 620 is configured to store processor-executable instructions that when executed by the processor 610 cause the processor 610 to perform a method disclosed herein, such as the method 700 discussed below.

Figure 7:
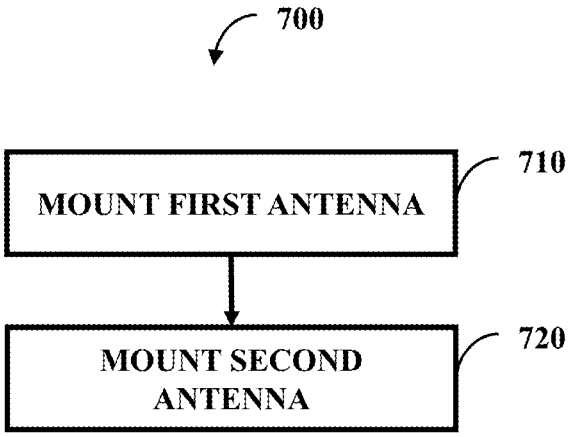
FIG. 7 illustrates one embodiment of a first method comprising two actions.

FIG. 7 illustrates one embodiment of a method 700 comprising two actions 710-720. These actions 710-720 can be performed upon a housing. The housing can comprise a first antenna retention portion configured to retain a first antenna (e.g., the first antenna 150 of FIG. 1) at a first position and a second antenna retention portion configured to retain a second antenna (e.g., the second antenna 160 of FIG. 1) at a second position. At 710, the first antenna can be mounted at the first position and at 720, the second antenna can be mounted at the second position. The first position and the second position can cause the first antenna and second antenna to function without interfering with one another, the first position can cause communication of the first antenna to be non-physically influenced by the housing (and the same for the second position), and the first position can cause communication of the second antenna to be non-physically influenced by the housing (and conversely for the second position with respect to the first antenna).

In one embodiment, the first antenna and the second antenna can function at different frequencies or the same frequency. In one example, while functioning at different frequencies, the antennas can be horn antennas that function within a frequency band. This can be, for example, when both antennas are of a similar band.

In one embodiment, at least one antenna can be a high-band antenna. The high-band antenna can function, in one example, within a frequency range of 18 Gigahertz (GHz) to 40 GHz. In one example, the high-band antenna can be a double ridge guide horn high-band antenna.

In one embodiment, at least one antenna can be a mid-band antenna. The mid-band antenna can function, in one example, within a frequency range of 700 Megahertz, to 18 Ghz. In one example, the mid-band antenna can be a double ridge guide horn mid-band antenna.

The antennas can work together while integrated with the housing. The first antenna can be a transmission antenna configured to transmit a signal. Meanwhile, the second antenna can be a reception antenna configured to receive a response to the signal after transmission. Therefore, the antennas can function together with regard to the signal. To improve performance, the first antenna and second antenna can be positioned while retained by their respective portions. This positioning can be automated and/or performed by a technician. Example positioning can be moving the individual antennas vertically, horizontally, or rotationally. This positioning can be independent (e.g., the first antenna can be moved while the second antenna remains unmoved) or dependent. In one example, the antennas can be mid-band antennas and moving the antennas can allow for waveguide re-orientation that defines polarization of an emitted transverse electromagnetic wave.

Different configurations can be used to lower (e.g., minimize) interference for the antennas. The first antenna and second antenna can be separated by a plate such that coupling between the first antenna and the second antenna is avoided. The first antenna retention portion and the plate can be configured relative to one another such that the first antenna can be configured to not interfere with itself while retained. As an example of this, the plate can be made of and/or coated in an absorptive material to cause a result as illustrated in FIG. 1*c*.

The plate can be a divider configured to prevent coupling between the first antenna and the second antenna. The first antenna can be supported by a first antenna base and the second antenna can be supported by a second antenna base. The divider and the bases can be movable (e.g., raised/lowered, left/right, or forward/back) and the antennas themselves can be moved while part of the bases (e.g., rotated, horizontally, or vertically). In one example, the bases can be moved to cause the first antenna and the second antenna to physically align about flush with one another along a plane of their main transmission side (e.g., the horn part of the antennas are aligned with one another such that one antenna does not extend past another antenna).

While the methods disclosed herein are shown and described as a series of blocks, it is to be appreciated by one of ordinary skill in the art that the methods are not restricted by the order of the blocks, as some blocks can take place in different orders. Similarly, a block can operate concurrently with at least one other block.

What is claimed is:

1. A housing, comprising:

a first antenna retention portion configured to retain a first antenna at a first position;

a second antenna retention portion configured to retain a second antenna at a second position; and a plate configured to separate the first antenna retention portion and the second antenna retention portion such that coupling between the first antenna and the second antenna is avoided, where the plate is movable within the housing to create a situation such that the first antenna and the second antenna function without interfering with one another, where the first antenna retention portion is configured to be independently rotated manually where the second antenna retention portion is configured to be independently rotated manually, where the first antenna retention portion is configured to be independently moved horizontally manually, where the second antenna retention portion is configured to be independently moved horizontally manually, where the first antenna retention portion is configured to be independently moved vertically manually, where the second antenna retention portion is configured to be independently moved vertically manually.

2. The housing of claim 1, where the first antenna retention portion and the plate are configured relative to one another such that the first antenna can be configured to not interfere with itself while retained.

3. The housing of claim 1, where the first antenna and the second antenna function independently at different frequencies.

4. The housing of claim 1, where the first antenna is a transmission antenna configured to transmit a signal and where the second antenna is a reception antenna configured to receive a response to the signal after transmission.

5. The housing of claim 1, where the first antenna and the second antenna function in the same frequency band and where the first antenna and the second antenna are horn antennas.

6. The system of claim 1, where the first antenna is a transmission antenna configured to transmit a signal and where the second antenna is a reception antenna configured to receive a response to the signal after transmission.

7. The system of claim 1, where the first antenna and the second antenna function independently at different frequencies.

8. The housing of claim 1, comprising:

couple hardware configured to couple the housing to a structure.

9. A system, comprising:

a first antenna mount configured to support a first antenna;

a second antenna mount configured to support a second antenna; and a separator configured to separate the first antenna when mounted from the second antenna when mounted, configured to cause the first antenna to not interfere with itself, and configured to cause the second antenna to not interfere with itself, where the first antenna mount, the second antenna mount, and the separator are physically connected to one another, where, while retained in the first antenna retention portion, the first antenna is configured to be independently moved vertically, where, while retained in the second antenna retention portion, the second antenna is configured to be independently moved vertically, where, while retained in the first antenna retention portion, the first antenna is configured to be independently moved horizontally, where, while retained in the second antenna retention portion, the second antenna is configured to be independently moved horizontally, where, while retained in the first antenna retention portion, the first antenna is configured to be independently rotated, and where, while retained in the second antenna retention portion, the second antenna is configured to be independently rotated.

10. The system of claim 9, where the first antenna is a transmission antenna configured to transmit a signal and where the second antenna is a reception antenna configured to receive a response to the signal after transmission.

11. The system of claim 10, where, while retained in the first antenna retention portion, the first antenna is movable in alignment with the second antenna, when retained in the second retention portion, and the second antenna is movable in alignment with the first antenna to orientate the first antenna with the second antenna such that polarization is defined.

12. The system of claim 11, where the first antenna is configured to be tilted along the x-axis while mounted on the first antenna base, where the first antenna is configured to be tilted along the y-axis while mounted on the first antenna base, where the second antenna is configured to be tilted along the x-axis while mounted on the second antenna base, and where the second antenna is configured to be tilted along the y-axis while mounted on the second antenna base.

13. The system of claim 12, where the separator is movable along the x-axis, where the separator is movable along the y-axis, and where the separator is movable along the x-axis.

14. The system of claim 13, where the independent movement of the first antenna is performable manually and where the independent movement of the second antenna is performable manually.

15. The system of claim 13, where the movement of the independent movement of the first antenna is performable by a control apparatus sending an instruction set and where the movement of the independent movement of the second antenna is performable by a control apparatus sending an instruction set.

16. The system of claim 9, where the first antenna and the second antenna function independently at different frequencies.

17. A system, comprising:

a first antenna base configured to support a first antenna; and a second antenna base configured to support a second antenna;

a separator configured to separate the first antenna when supported from the second antenna when supported, configured to cause the first antenna to not interfere with itself, and configured to cause the second antenna to not interfere with itself, where the first antenna base is part of a housing, where the second antenna base is part of the housing, where the first antenna is, at least in part a transmission antenna configured to transmit a signal, where the second antenna is, at least in part, a reception antenna configured to receive a response to the signal, where the first antenna base is x-axis movable, y-axis movable, z-axis movable, and rotationally movable within the housing, and where the second antenna base is x-axis movable, y-axis movable, z-axis movable, and rotationally movable within the housing.

18. The system of claim 17, where the first antenna base and the second antenna base are configured to have an arrangement where the first antenna and the second antenna physically align about flush with one another along a plane of their main transmission side.

19. The system of claim 17, where the movement of the first antenna base and the second antenna base are independent, where the first antenna base is movable to align the first antenna with the second antenna, where the second antenna base is movable to align the second antenna with the first antenna, and where alignment of the first antenna base and the second antenna base cause a polarization match with regard to the first antenna and the second antenna.

20. The system of claim 17, where movement of the first antenna base and movement of the second antenna base are interdependent.

* * * * *